US005116200A

United States Patent [19]

Catlow et al.

[11] Patent Number: 5,116,200

[45] Date of Patent: May 26, 1992

[54] APPARATUS AND METHODS FOR MINIMIZING VIBRATIONAL STRESSES IN AXIAL FLOW TURBINES

[75] Inventors: William G. Catlow, Princeton; Edward T. Vitone, Jr., Ashburnham, both of Mass.

[73] Assignee: General Electric Company, Schenectady, N.Y.

[21] Appl. No.: 544,956

[22] Filed: Jun. 28, 1990

[51] Int. Cl.[5] ..... F01D 1/02

[52] U.S. Cl. ..... 415/183; 415/208.1

[58] Field of Search ..... 415/198.1, 198.4, 199.5, 415/208.1, 183, 119, 914

[56] References Cited

U.S. PATENT DOCUMENTS

| | | | |
|---|---|---|---|
| 1,537,465 | 5/1925 | Hutchinson | 415/202 |
| 2,172,993 | 9/1939 | Sturtevant | 415/199.5 |
| 2,186,952 | 1/1940 | Bloomberg | 415/199.5 |
| 2,259,126 | 10/1941 | Dickinson | 415/199.5 |
| 3,640,638 | 2/1972 | Britt et al. | 415/172 |
| 3,898,013 | 8/1975 | Engelke et al. | 415/199.5 |
| 4,403,915 | 9/1983 | Teufelberger | 415/199 |
| 4,426,191 | 1/1984 | Brodell et al. | 415/189 |
| 4,720,239 | 1/1988 | Owczarek | 415/181 |
| 4,844,692 | 7/1989 | Minkkinen et al. | 415/208 |
| 4,881,872 | 11/1989 | Butikofer | 415/199.5 |

*Primary Examiner*—John T. Kwon

*Attorney, Agent, or Firm*—Nixon & Vanderhye

[57] ABSTRACT

The axial flow turbine has an asymmetrical flow input, for example, at the first nozzle plate and which flow is attenuated towards an axi-symmetric flow by a baffle plate located between the first nozzle plate and the second stage. The baffle plate directs the flow towards a more symmetrical flow pattern before permitting the flow to pass through the second stage. Consequently, the long turbine blades in the later stages of the turbine respond to an attenuated asymmetrical flow rather than a larger asymmetrical flow which might induce vibrations or vibrations at the natural resonant frequency of the turbine blading which could break the turbine blades.

10 Claims, 2 Drawing Sheets

APPARATUS AND METHODS FOR MINIMIZING VIBRATIONAL STRESSES IN AXIAL FLOW TURBINES

BACKGROUND AND SUMMARY OF THE INVENTION

The present invention relates to multi-stage axial flow turbines and particularly relates to apparatus and methods for minimizing the vibrational stress in downstream turbine blades caused by asymmetrical flow in the turbine.

In a conventional multi-stage axial flow turbine, for example, a steam turbine, gas flows through the rotor blades and stator blades of each stage in a generally axial direction. Turbine blade lengths typically increase in radial length in the downstream direction of flow such that the turbine blades in the later stages have substantial radial lengths. In a conventional steam turbine, asymmetrical flow is often input through a first-stage nozzle plate. That is, the flow is not input to the turbine 360° about its axis. Rather, the input is asymmetrical, for example, on the order of 180° about the turbine axis or at multiple flow inputs asymmetrically arranged about the turbine axis. In the instance of an asymmetrical input of about 180°, it will be appreciated that the flow profile exiting the asymmetrically arranged first-stage nozzles looking axially upstream toward the nozzles would resemble a square wave, with the width of the wave proportional to the nozzle arc length. As the flow passes through the second stage, the asymmetric flow pattern about the turbine axis attenuates somewhat but remains asymmetrical. That is, it tends towards symmetry about the turbine axis. As the flow passes through succeeding stages, the attenuation of the asymmetrical flow continues until the flow reaches the last stage. Depending upon the strength and shape of the flow pattern exiting the first stage, as well as the number of stages between the first stage and the last stage, the resulting flow pattern entering the last stage or stages can result in excessive vibration stresses on the radially longer turbine blades of those downstream stages due to residual asymmetrical flow patterns acting on those long blades.

The interaction between the natural frequencies of the turbine blades and the nozzle excitation is well known. It has been common practice to consider such interaction at various running speeds to ensure high turbine reliability. That is, when the turbine runs at different speeds, it is possible to run the turbine at a speed that will excite the natural resonance of the turbine blades leading to excessive vibrational stresses. It will be appreciated that the turbine blades vibrate at different frequencies depending upon their shape and the speed of the turbine. It has been discovered, however, that the asymmetry of the flow, i.e., partial arc flow disturbances, present in the first stage of a turbine can filter through the entire axial flow path and influence the vibration stresses in the longer turbine blades of the last stage or stages. Actual practice has demonstrated that at certain running speeds, the asymmetrical flow pattern introduced in the early stages of the turbine can cause the long turbine blades in the later turbine stages to vibrate at their natural frequency, causing stress on the blades. If the vibration has a sufficient magnitude, the blades may break.

According to the present invention, apparatus and methods are provided for positively attenuating the asymmetric axial flow through the turbine such that the flow tends toward axi-symmetric flow in the later stages of the turbine. Thus, in accordance with the present invention, a flow baffle is provided downstream of the first stage nozzle plate through which the asymmetrical flow is introduced into the turbine. Particularly, the baffle is disposed before the stator blades of the next stage downstream from the introduction of the asymmetrical flow through the first-stage nozzle plate. The baffle extends annularly about the stator blading, causing the asymmetric flow to flow about the baffle before it is introduced into the second-stage nozzles. This tends to direct the flow about the turbine axis. Consequently, the asymmetric flow pattern is positively attenuated toward an axi-symmetric flow pattern by the baffle. By positively attenuating the initial asymmetrical flow at an early stage in the turbine, the flow pattern in the later stages obtains greater symmetry about the turbine axis than otherwise, thereby reducing or minimizing the vibrational stress imposed on the later-stage longer turbine blades caused by turbine blade response to asymmetrical flow. Stated differently, because the natural frequency of vibration of the radially longer blades of the later turbine stages can be excited by asymmetrical flow, the input asymmetrical flow pattern is positively directed to a substantially symmetrical flow in the later stages or at least an asymmetrical flow pattern which does not cause harmful vibrational stresses and does not cause the turbine blading to resonate at its natural frequency.

It will also be appreciated that, in accordance with the present invention, the flow attenuation is not limited to asymmetrical flow disturbances occurring between the first and second stages of the turbine. In many turbines, asymmetrical flow is introduced into intermediate stages of the turbine. Where this is done, a baffle according to the present invention may be provided at the next stage downstream from the intermediate asymmetric flow disturbance to attenuate the asymmetry of that flow toward axi-symmetric flow in the later stages of the turbine.

In a preferred embodiment according to the present invention, there is provided a multi-stage axial flow turbine, comprising a plurality of turbine stages arranged in the direction of axial flow with each stage including a plurality of stator blades and a plurality of rotor blades, means carried by the turbine for introducing gas under pressure asymmetrically about the axis of the turbine into the turbine stages and a baffle disposed downstream of the introducing means for attenuating the asymmetry of the gas flow in the turbine stages downstream of the baffle.

In a further preferred embodiment according to the present invention, there is provided a multi-stage axial flow turbine, comprising a plurality of turbine stages arranged in the direction of axial flow with each stage including a plurality of stator blades and a plurality of rotor blades, the rotor blades of subsequent stages having blades radially longer in length than the length of the rotor blades in preceding stages, means carried by the turbine for introducing asymmetrical flow into the turbine stages and a baffle disposed downstream of the introducing means for attenuating the asymmetry of the flow in turbine stages downstream of the baffle to prevent vibration of the longer rotor blades substantially at their natural resonant frequencies as a result of the asymmetrical flow. In a further aspect of this invention, there is provided, in a multi-stage axial flow turbine having a plurality of turbine stages arranged in the direction of axial flow, a method of minimizing vibration stresses in rotor blades downstream of an asymmetrical flow input to the turbine comprising the step of attenuating the asymmetrical flow by directing the flow toward an axi-symmetric flow downstream of the asymmetrical flow input.

Accordingly, it is a primary object of the present invention to provide apparatus and methods for minimizing vibrational stresses in downstream turbine blades in response to asymmetrical flow input to the turbine.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
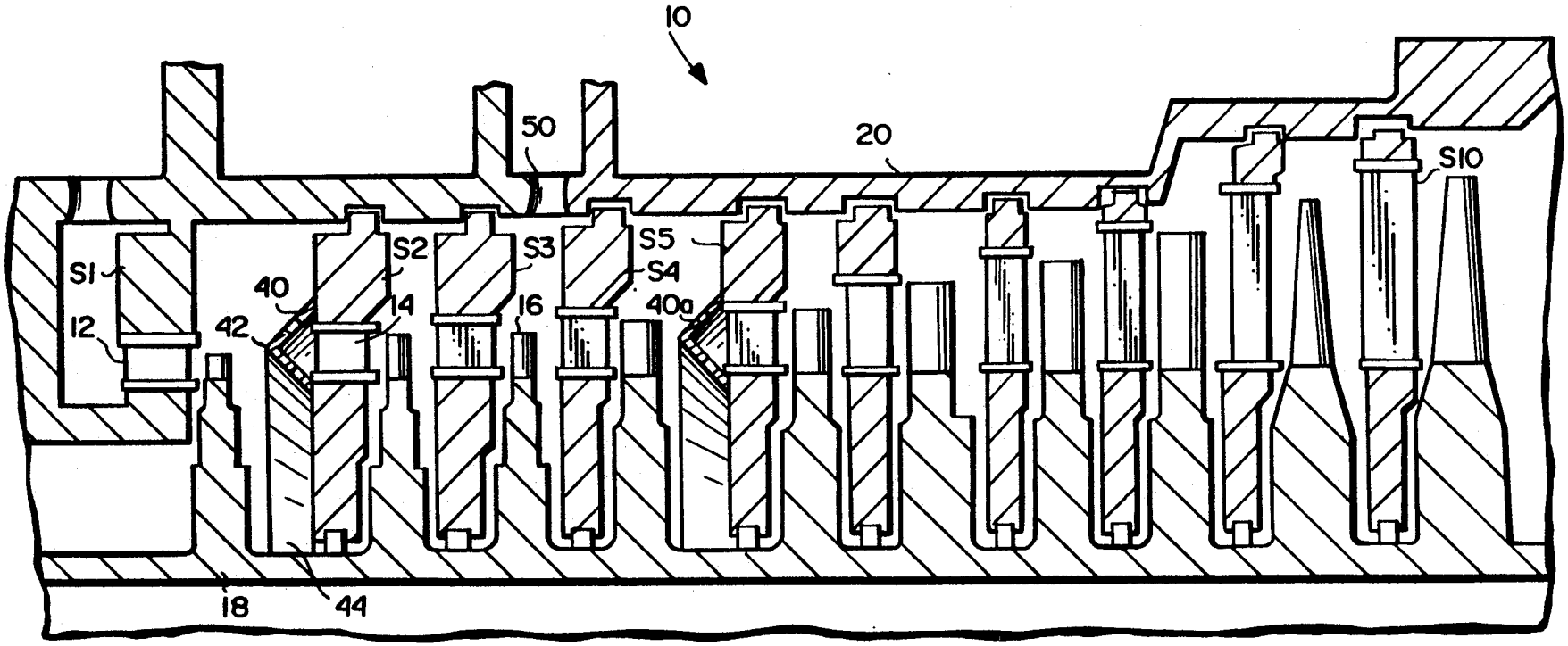
FIG. 1 is a fragmentary cross-sectional view of a typical turbine in which asymmetrical flow is introduced at initial and intermediate stages and which illustrates the locations of a flow attenuating baffle constructed in accordance with the present invention.

Referring now to FIG. 1, there is illustrated a turbine, generally designated 10, having a plurality of stages S1, S2, S3, S4, S5 . . . S10, including a first-stage nozzle plate 12. As typical in turbines, each stage includes fixed stator blades 14 with axial juxtaposed turbine blades 16, the latter being mounted on rotors connected to a rotating shaft 18. The stator blades 14 are, of course, fixed to the turbine housing 20 and the flow of the gases through the turbine is from left to right, as illustrated in FIG. 1. It will also be appreciated that the radial extent of the turbine blades increases with their axial location in the turbine in a downstream direction as evident from the illustration.

Figure 2:
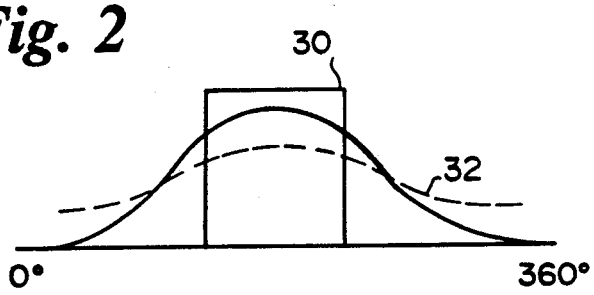
FIGS. 2 and 3 are representations of turbine flow profiles at various ones of the turbine stages for purposes of illustrating and representing the asymmetric flow pattern and its attenuation.
Figure 3:
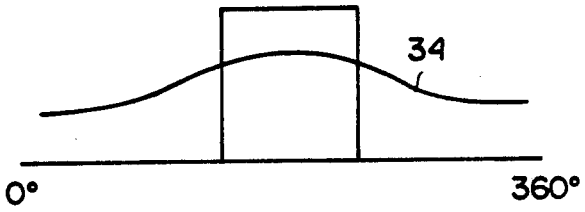

Before discussing in detail the apparatus and methods for attenuating the asymmetric flow input through nozzle plate 12, reference is made to FIGS. 2 and 3 for a further explanation of the concepts of the present invention. In FIG. 2, there is illustrated a plot of a flow profile as a function of the circumferential position of the flow about the turbine. For example, if 0° represents the six o'clock position about the turbine, the flow pattern from an asymmetric flow input of about 180° from the nine o'clock to the three o'clock positions to the first nozzle plate 12 might appear conceptually as a square wave 30 extending between the 90°-270° positions of the plot. As the flow passes through the first few stages, the asymmetric flow pattern attenuates into other circumferential positions of the turbine and the flow profile, for example, at stage 3, may appear as the dashed line configuration designated 32 in FIG. 2. The flow pattern 32 remains asymmetrical but to a lesser extent than the flow profile at the initial nozzle plate 12 and, thus, the flow profile tends toward an axi-symmetric profile. The flow profile tends to flatten out as the gases move downstream until, as illustrated in FIG. 3, the last stage or stages will see a flow profile as indicated by the line 34. Note that the asymmetry of the flow pattern has not been completely flattened out to a completely symmetrical flow. Thus, the turbine blades of the final stages remain affected by the vibrational stresses induced by this residual asymmetric flow.

Referring now back to FIG. 1, there is provided an annular baffle plate 40 for positively attenuating the asymmetric flow input to the turbine towards an axi-symmetric flow in the later turbine stages to such an extent that the asymmetry of the flow pattern in the later stages causes minimal vibrational stresses in the long turbine blades and are insufficient to cause excitation of the long turbine blades at their natural frequencies. To accomplish this, the annular baffle 40 is disposed immediately downstream of the stage through which the asymmetrical disturbance is input to the turbine. In the preferred embodiment of the invention illustrated in FIG. 1, the baffle 40 includes two angularly related legs 42 and 44, which overlie and cover the circumferentially spaced stator blades 14. Baffle 40 thus prevents the direct inflow of gas from the first stage into the second stage.

Figure 4:
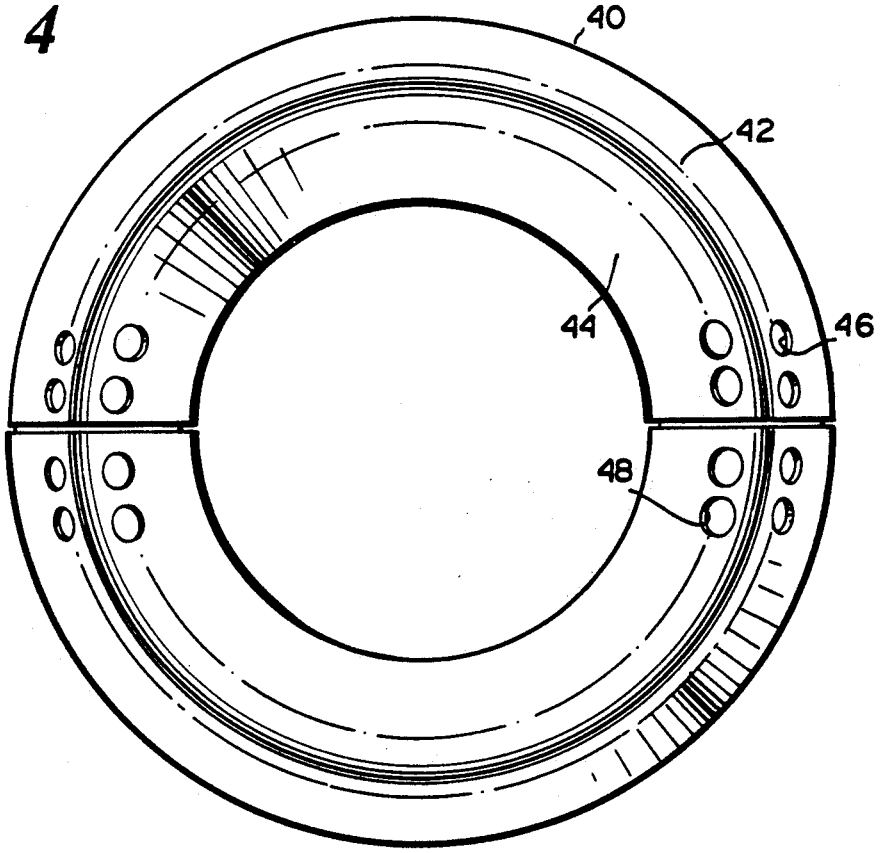
FIG. 4 is an enlarged end elevational view of a baffle for use in the present invention.

As best illustrated in FIG. 4, baffle 40 has a plurality of openings 46 and 48 spaced circumferentially thereabout. Particularly, the openings 46 are spaced circumferentially one from the other in leg 42 of baffle 40, while the openings 48 are spaced circumferentially one from the other in leg 44 of baffle 40. As a consequence of this arrangement, the asymmetrical gas flow from the first stage S1 tends to flow around and about the baffle before flowing through openings 46 and 48 into the second stage S2. In this manner, the asymmetrical flow pattern is dissipated or attenuated such that a more axi-symmetrical flow pattern is achieved in the early stages of the turbine than would otherwise be the case absent baffle 40. Consequently, referring back to FIG. 2, the flow pattern in the third stage S3 would have an asymmetrical flow profile similar to the dashed line 32 but slightly more flattened out, i.e., more symmetrical. As a consequence, when the flow reaches the last stage or stages of the turbine, a generally symmetrical flow, or an asymmetrical flow which can be tolerated by the turbine blading from the standpoint of asymmetrical flow-induced stresses, is provided.

It will be appreciated that the flow attenuating apparatus hereof, i.e., baffle 40, may be disposed at substantially any location in the turbine downstream of an asymmetrical flow input. Thus, in FIG. 1, there is illustrated a second inlet 50 for inputting asymmetrical flow into the turbine before stage S4. Thus, stage S4 serves as the initial nozzle plate for the asymmetrical flow input and a baffle **40*a* may be disposed in front of stage S5. The baffle will perform the similar function as the baffle 40** previously described.

It will be also be appreciated that more than one baffle may be disposed in the turbine for each asymmetric flow disturbance. Thus, where the only disturbance is from the initial input, the turbine may have one or more baffles for attenuating the asymmetrical flow disturbance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-stage axial flow turbine, comprising:

a plurality of turbine stages arranged in the direction of axial flow with each stage including a plurality of stator blades and a plurality of rotor blades:

means carried by the turbine for introducing gas under pressure asymmetrically about the axis of the turbine into the turbine stages; and a baffle disposed downstream of said introducing means for attenuating the asymmetry of the gas flow in the turbined stages downstream of said baffle, said baffle including an annular member disposed between the rotor blades of one stage and the stator blades of an adjacent subsequent stage and against which member the gas from said one stage rotor blades impinges for diversion towards an axi-symmetric flow prior to flowing through the stator blades of said subsequent stage, said member (i) having a plurality of apertures therethrough, (ii) extending symmetrically about the axis of the turbine and (iii) overlying the stator blades in a radial direction, to enable gas flow around and about the baffle before flowing through said openings.

2. A turbine according to claim 1 wherein said introducing means is disposed downstream of a first of said plurality of said stages.

3. A turbine according to claim 1 including a plurality of said baffles disposed between said stages downstream of said introducing means.

4. A turbine according to claim 1 wherein said baffle directs the flow towards an axi-symmetric flow in stages downstream of said baffle.

5. A multi-stage axial flow turbine, comprising:

a plurality of turbine stages arranged in the direction of axial flow with each stage including a plurality of stator blades and a plurality of rotor blades, the rotor blades of subsequent stages having blades radially longer in length than the length of the rotor blades in preceding stages;

means carried by the turbine for introducing asymmetrical flow into the turbine stages; and a baffle disposed downstream of said introducing means for attenuating the asymmetry of the flow in turbine stages downstream of said baffle to prevent vibration of the longer rotor blades substantially at their natural resonant frequencies as a result of the asymmetrical flow, said baffle including an annular member disposed between the rotor blades of one stage and the stator blades of an adjacent subsequent stage and against which member the gas from said one stage rotor blades impinges for diversion towards an axi-symmetric flow prior to flowing through the stator blades of said subsequent stages, said member (i) having a plurality of apertures therethrough, (ii) extending symmetrically about the axis of the turbine and (iii) overlying the stator blades in a radial direction, to enable gas flow around and about the baffle before flowing through said openings.

6. A turbine according to claim 5 wherein said introducing means is disposed downstream of a first of said plurality of said stages.

7. A turbine according to claim 5 including a plurality of said baffles disposed between said stages downstream of said introducing means.

8. A turbine according to claim 5 wherein said baffle directs the flow towards an axi-symmetric flow in stages downstream of said baffle.

9. In a multi-stage axial flow turbine having a plurality of turbine stages arranged in the direction of axial flow, a method of minimizing vibration stresses in rotor blades downstream of an asymmetrical flow input to the turbine comprising the step of attenuating the asymmetrical flow by directing the flow toward an axi-symmetric flow downstream of said asymmetrical flow input, the step of direction including locating an annular baffle between the input asymmetrical flow and the downstream rotor blades, providing a plurality of openings through said baffle and directing the flow of gas around and about the baffle before flowing through the openings.

10. A method according to claim 9 including providing rotor blades in succeeding turbine stages in a downstream direction of increasing length in a radial direction.

* * * * *